US010113721B1

(12) United States Patent
Lin

(10) Patent No.: US 10,113,721 B1
(45) Date of Patent: Oct. 30, 2018

(54) LED LAMP

(71) Applicant: Ruei-Hsing Lin, New Taipei (TW)

(72) Inventor: Ruei-Hsing Lin, New Taipei (TW)

( * ) Notice: Subject to any disclaimer, the term of this patent is extended or adjusted under 35 U.S.C. 154(b) by 0 days.

(21) Appl. No.: 15/807,581

(22) Filed: Nov. 9, 2017

(51) Int. Cl.

| | |
|---|---|
| ***F21V 29/83*** | (2015.01) |
| ***F21V 19/00*** | (2006.01) |
| ***F21K 9/20*** | (2016.01) |
| ***F21V 23/00*** | (2015.01) |
| *F21Y 115/10* | (2016.01) |
| *F21Y 103/10* | (2016.01) |

(52) U.S. Cl.
CPC ..... *F21V 19/0045* (2013.01); *F21K 9/20* (2016.08); *F21V 23/002* (2013.01); *F21V 29/83* (2015.01); *F21Y 2103/10* (2016.08); *F21Y 2115/10* (2016.08)

(58) Field of Classification Search
CPC .. F21V 23/002; F21V 19/0045; F21V 19/004; F21Y 2103/10
USPC ..... 362/218
See application file for complete search history.

(56) References Cited

U.S. PATENT DOCUMENTS 6,659,623 B2 * 12/2003 Friend ..... F21V 21/002 250/504 R
2010/0201239 A1 * 8/2010 Mostoller ..... F21S 8/031 313/1
2013/0021792 A1 * 1/2013 Snell ..... F21S 8/06 362/218
2013/0121759 A1 * 5/2013 Breidenassel ..... F21V 7/00 403/330
2013/0176728 A1 * 7/2013 Bizzotto ..... F21V 21/08 362/244
2013/0314917 A1 * 11/2013 Su ..... F21V 15/01 362/235
2014/0009926 A1 * 1/2014 Simon ..... F21V 17/12 362/222
2015/0276139 A1 * 10/2015 Rowlette, Jr. ..... F21K 9/175 362/249.06
2017/0059144 A1 * 3/2017 Lin ..... F21V 29/70
2017/0138578 A1 * 5/2017 Pearson ..... F21V 23/002
2017/0167665 A1 * 6/2017 Germain ..... F21V 17/164
2017/0241627 A1 * 8/2017 Stuart ..... E04F 19/02
2017/0292664 A1 * 10/2017 Pearson ..... F21V 5/04

* cited by examiner

*Primary Examiner* — Christopher Raabe
(74) *Attorney, Agent, or Firm* — Leong C. Lei

(57) ABSTRACT

The light emitting diode (LED) lamp includes an aluminum platform, a LED module, a heat sinking piece, two insulating strips, two conductive wires, and two positioning elements. The LED module and the heat sinking piece are mounted to the platform. Each conductive wire is embedded in the insulating strip and both are configured on the platform so that the LED module is electrically connected to the conductive wires. Each positioning element includes a connector portion for connecting an end of the LED module and the heat sinking element, two elastic arms extended downward from the positioning element's two ends, and an upwardly curved band whose two ends are connected to the two ends of the connector portion. Each elastic arm has a wedge at a bottom end for plugging into a groove of the platform. The LED lamp therefore provides quick and easy assembly and disassembly.

5 Claims, 5 Drawing Sheets

LED LAMP

BACKGROUND OF THE INVENTION

(a) Technical Field of the Invention

The present invention generally relates to light emitting diode (LED) lamps, and more particularly to a LED lamp with quick and easy assembly and disassembly.

(b) Description of the Prior Art

Due to the recently increased awareness about environmental protection, carbon emission reduction, and energy conservation, the efficiency of lighting devices has become a key issue. The most efficient light devices known today are fluorescent lamps, PL lamps, and energy saving light bulbs. These devices' power consumption depends on the number of lighting device employed. More light devices imply more power consumption. For example, four 20 W fluorescent lamps would consume 20 W×4=80 W. The same also applies to PL lamps and energy saving light bulbs. In addition, for PL lamps and energy saving light bulbs, their operational lives and power consumption are still inferior to light emitting diodes (LEDs), despite their improved efficiency. Furthermore, these lighting devices are all made of glass and suffer the potential hazard of explosion, especially when they are installed, recycled, and transportation.

In contrast, LEDs are free from the above limitations and shortcomings. LED lamps therefore become the mainstream solution of lighting devices.

According existing technology and research, LEDs used for lighting has advantages such as high brightness, wide coverage, superior lighting characteristics, and low power consumption. Especially due to their high energy efficiency and reduced manufacturing cost, demands for LED lamps are continuously increasing.

LEDs are driven by DC and, to apply AC, it has to be converted to DC first. The heat produced from the conversion process has to be ventilated by heat sinking modules. Otherwise, the accumulated heat would have adversary effect to the LEDs' performance and operational life. As such, effective heat sinking becomes a major technique in developing LED lamps.

Existing heat sinking techniques, such as aluminum strips or plates, focus only on heat dissipation, and usually cannot be integrated into the electricity provision. When multiple LED modules are involved, they have to be welded together and then electricity is applied. So far there is still no enhanced electricity provision mechanism for LED lamps. For LED lamps with lengthy circuit boards, or when they are cascaded, the power attenuation problem has limit the applicability of LED lamps.

The existing provision mechanisms such as external connection, wire connection, all suffer problems such as difficulties and increased costs in installation and wiring. Therefore an enhanced solution is required.

SUMMARY OF THE INVENTION

Therefore a novel light emitting diode (LED) lamp is provided herein. The LED lamp includes an aluminum platform, a LED module, a heat sinking piece, two insulating strips, two conductive wires, and two positioning elements. The LED module, the heat sinking piece, and the platform are stacked so that heat from the LED module may be quickly dissipated to the platform. The conductive wires are embedded in the insulating strips, and both are configured on the platform so that the LED module is electrically connected to the conductive wires. The positioning elements are connected to the two ends of the LED module and heat sinking piece. Each positioning element includes two elastic arms extended downward, and an upwardly curved band. Each elastic arm has a wedge at a bottom end for plugging into a groove of the platform.

The gist of the present invention lies in the positioning elements. To assemble the LED lamp, the two ends of the LED module and the heat sinking piece are first plugged into the positioning elements. The positioning elements, together with the LED module and the heat sinking piece, are joined to the platform by embedding the wedges into the platform. To disassemble, pulling the bands of the positioning elements would expands the wedges outward and, as such, the wedges release their locking to the platform. Then the positioning elements, together with the LED module and the heat sinking piece, are detached from the platform. The LED lamp therefore provides quick and easy assembly and disassembly.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings, identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

Figure 1:
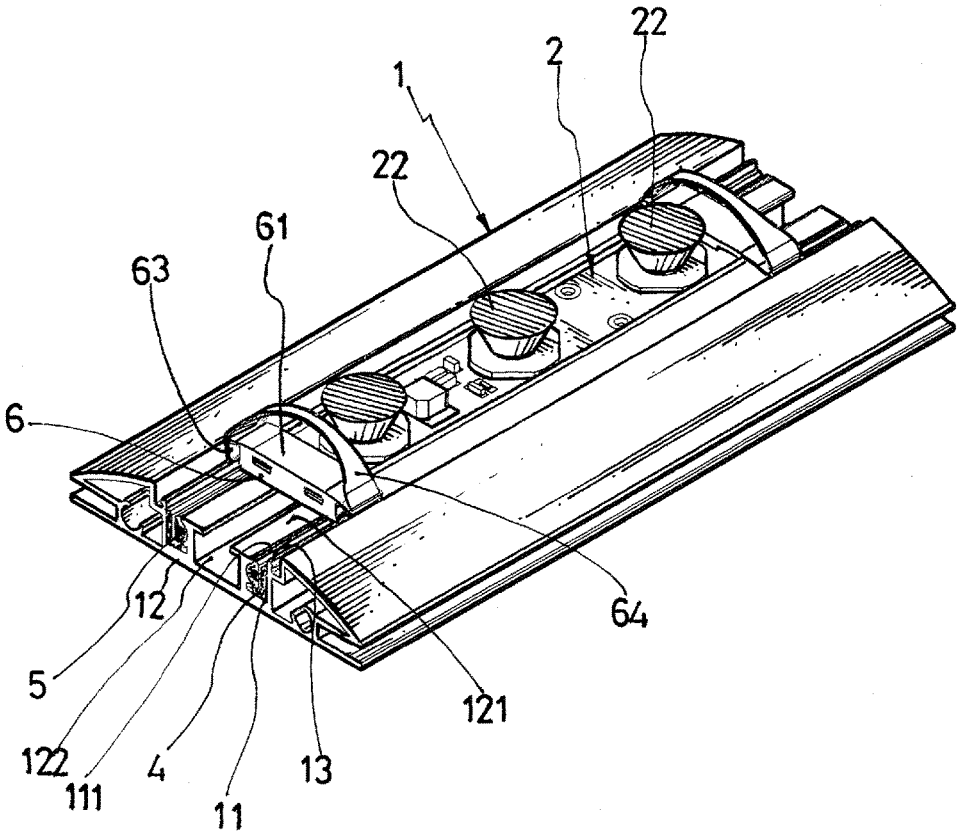
FIG. 1 is perspective diagram showing a LED (light emitting diode) lamp according to an embodiment of the present invention.
Figure 2:
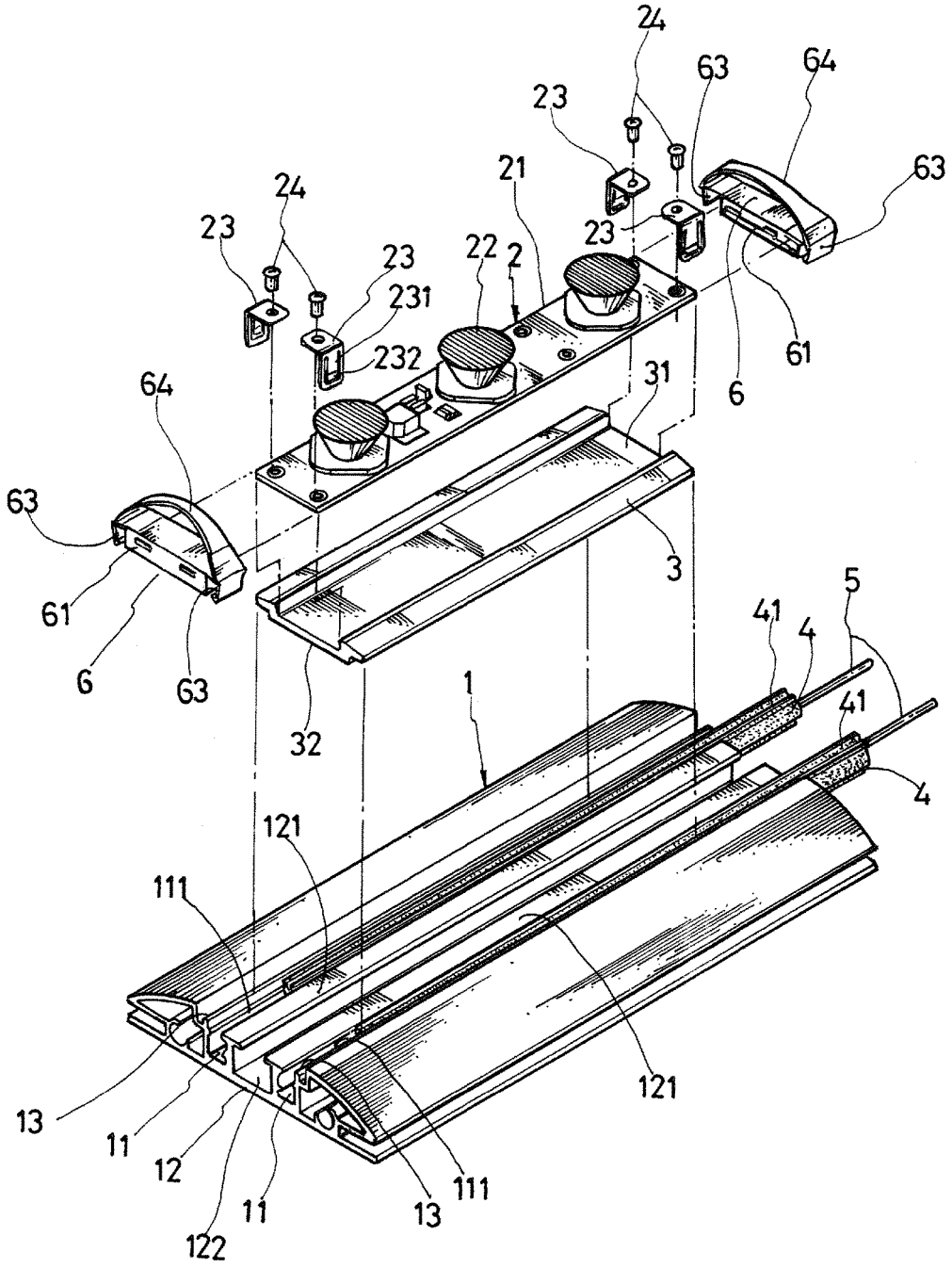
FIG. 2 is a perspective break-down diagram showing the LED lamp of FIG. 1.
Figure 3:
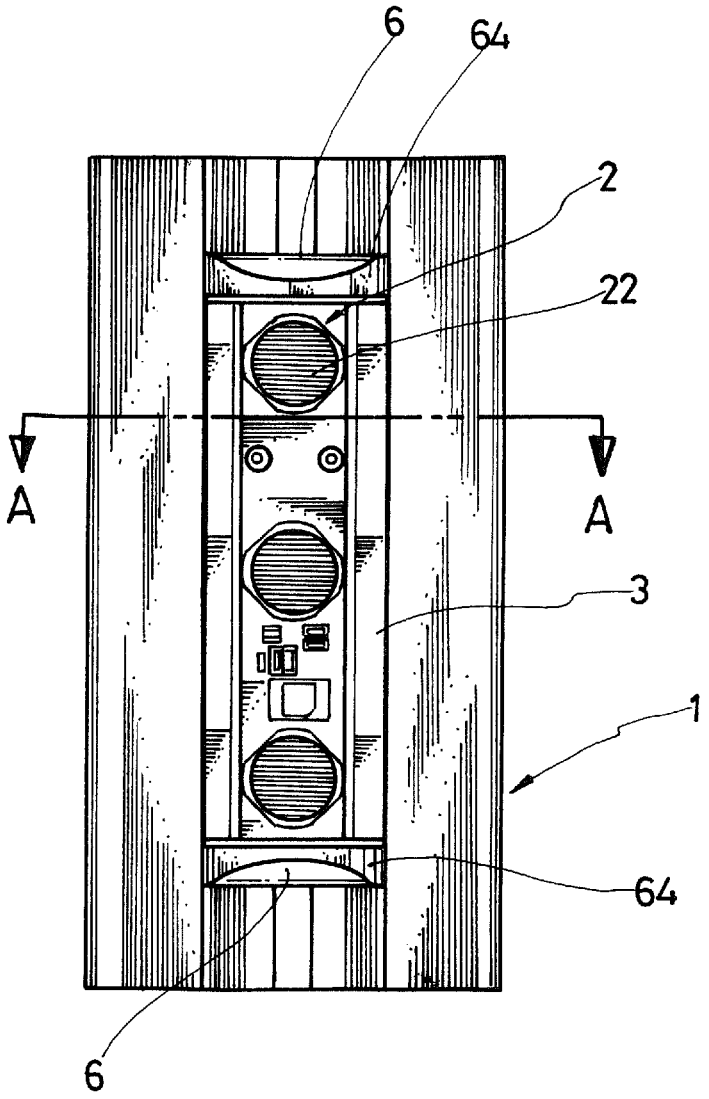
FIG. 3 is a top-view diagram showing the LED lamp of FIG. 1.
Figure 4:
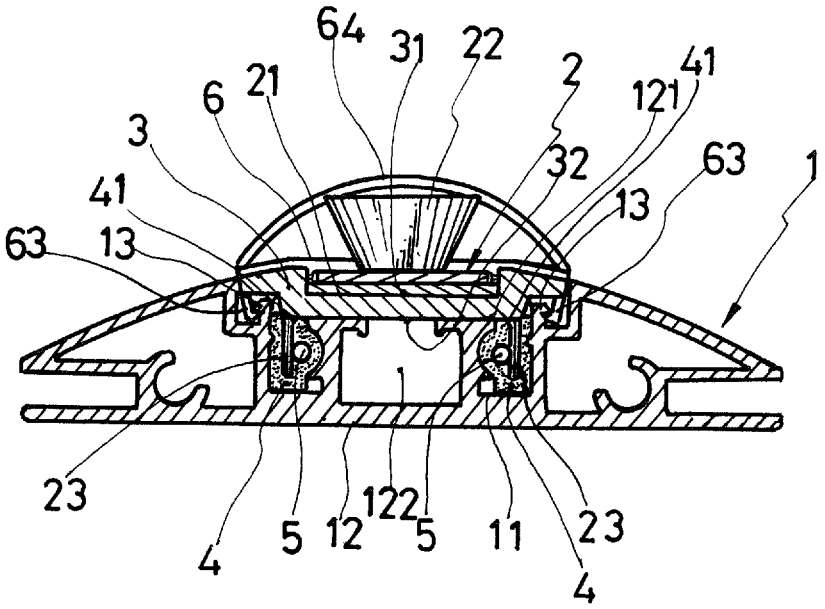
FIG. 4 is a schematic diagram showing the LED lamp along an A-A cross section of FIG. 3.

The following descriptions are exemplary embodiments only and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

As shown in FIGS. 1 to 5, a light emitting diode (LED) lamp according to an embodiment of the present invention includes an aluminum platform 1, a LED module 2, a heat sinking piece 3, two insulating strips 4, two conductive wires 5, and two positioning elements 6.

The platform 1 has an elongated end-to-end indentation on a top major side, and has two top-open grooves 13 opposing each other in parallel along the indentation's top rims, and two ducts 11 opposing each other in parallel beneath the grooves 13, respectively. The platform 1 further has a heat sinking bottom piece 12 beneath and between the ducts 11. Each duct 11 has a top slot 111 and the bottom piece 12 has to top contacting face 121. The indentation therefore has an end-to-end ventilation space 122 formed between the ducts 11 and above the bottom piece 12. The top slots 111, the contact face 121, and the grooves 13 are all opened or face in a same direction (e.g., upwards).

The LED module 2 is mounted to the platform 1, and includes a circuit board 21 with a number of LED lighting elements 22 configured on a top side, and at least two conductive pieces 23, one as a positive terminal and one as a negative terminal. Each conductive piece 23 has a lateral portion fixed to the circuit board 21 by a fastener 24, and an elastic vertical portion 231 extended vertically downward. Each vertical portion 231 has an outward protruding bump 232.

The heat sinking piece 3 is sandwiched between the platform 1 and the LED module 2, and has a first thermally conductive face 31 along a top side contacting a bottom side of the LED module 2 and a second thermally conductive face 32 along a bottom side contacting the contact face 121 of the platform 1.

Each insulating strip 4 is configured in a duct 11 and has a top slit 41 also opened in a same direction as the slot 111 of the duct 11.

Each conductive wire 5 is embedded in an insulating strip 4. One conductive wire 5 is connected to a positive port of an external power source (not shown) and the other conductive wire 5 is connected a negative port of the external power source.

Figure 5:
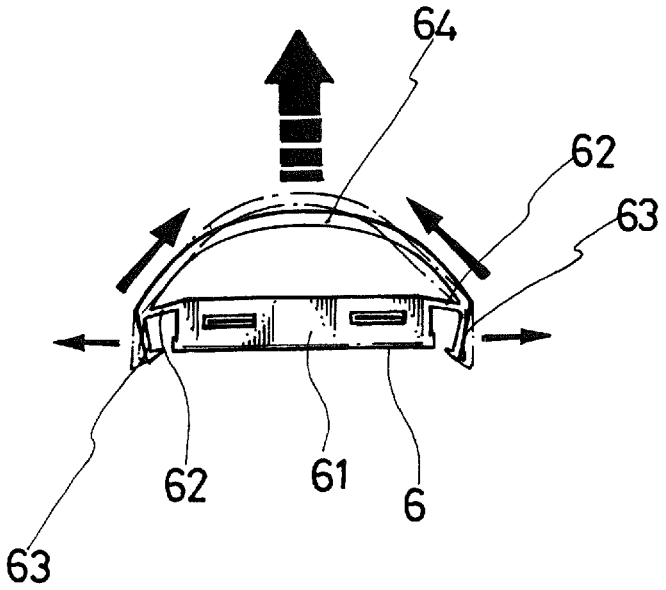
FIG. 5 is a side-view diagram showing a positioning element of the LED lamp of FIG. 1.

Two positioning elements 6 connect the two ends of the LED module 2 and the heat sinking piece 3, respectively, and then are plugged into the platform 1. Each positioning element 6 includes a connector portion 61 for connecting an end of the LED module 2 and the heat sinking piece 3, two elastic arms 62 extended downward from the positioning element 6's two ends, respectively. Each elastic arm 62 has a wedge 63 at a bottom end for plugging into a groove 13 of the platform 1. Each positioning element 6 further includes an upwardly curved band 64 whose two ends are connected the two ends of the connector portion 61, respectively. When the band 64 is pulled upward, as shown in FIG. 5, the elastic arms 62 are engaged to expand laterally outward.

To assemble the LED lamp, the two ends of the LED module 2 and the heat sinking piece 3 are first plugged into the connector portions 61 of the positioning elements 6. The positioning elements 6, together with the LED module 2 and the heat sinking piece 3, are joined to the platform 1 by embedding the wedges 63 into the grooves 13. To disassemble, pulling the bands 64 of the positioning elements 6 would expands the wedges 63 outward and, as such, the wedges 64 release their locking to the grooves 13. Then the positioning elements 6, together with the LED module 2 and the heat sinking piece 3, are detached from the platform 1. The LED lamp therefore provides quick and easy assembly and disassembly.

Please note that, when the LED modules 2 is coupled with the platform 1, the vertical portions 231 of the conductive pieces 23 are threaded through the slots 111, the top slits 41, and into the insulating strips 4. The vertical portions 231 are then electrically contacted with the conductive wires 5. Electricity form the external power source is as such introduced into the LED module 2. In other words, the LED lamp achieves electricity provisioning simultaneously while assembling. There is no need for additional wiring work. In addition, the bumps 232 at the tips of the vertical portions 231 provide reliable contact with the conductive wires 5.

Also, when the LED modules 2 is coupled with the platform 1, the heat sinking piece 3 are sandwiched between the LED module 2 and the aluminum platform 1. The heat produced from the LED module 2 is then quickly dissipated through the aluminum platform 1, achieving fast heat ventilation.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the claims of the present invention.

I claim:

1. A light emitting diode (LED) lamp, comprising a metallic platform having an elongated end-to-end indentation on a top major side, and two top-open grooves opposing each other in parallel along the indentation's top rims;

a LED module;

two positioning elements connecting the LED module's two ends, respectively, and plugged into the platform, where each positioning element comprises a connector portion for connecting an end of the LED module, two elastic arms extended downward from the positioning element's two ends, respectively, and a upwardly curved band whose two ends are connected to the two ends of the connector portion, respectively; each elastic arm has a wedge at a bottom end for plugging into a groove of the platform;

wherein, to assemble the LED lamp, the two ends of the LED module are plugged into the connector portions of the positioning elements; the positioning elements, together with the LED module, are joined to the platform by embedding the wedges into the grooves; to disassemble, pulling the bands of the positioning elements expands the wedges outward and, as such, the wedges release their locking to the grooves; then the positioning elements, together with the LED module, are detached from the platform.

2. The LED lamp according to claim 1, wherein the platform has two ducts opposing each other in parallel beneath the grooves, respectively, and a heat sinking bottom piece beneath and between the ducts; each duct has a top slot and the bottom piece has a top contacting face; the indentation has an end-to-end ventilation space formed between the ducts and above the bottom piece; the top slots, the contact face, and the grooves are all opened or face in a same direction; the LED module comprises a circuit board with a plurality of LED lighting elements configured on a top side, and at least two conductive pieces; each conductive piece has a lateral portion fixed to the circuit board, and an elastic vertical portion extended vertically downward; and each vertical portion has an outward protruding bump 232.

3. The LED lamp according to claim 2, further comprising a heat sinking piece sandwiched between the platform and the LED module whose two ends are connected to the positioning elements, respectively; wherein the heat sinking piece has a first thermally conductive face along a top side contacting a bottom side of the LED module and a second thermally conductive face along a bottom side contacting the contact face of the platform.

4. The LED lamp according to claim 2, further comprising two insulating strips and two conductive wires; wherein each insulating strip is configured in a duct; each insulating strip has a top slit opened in a same direction as the slot of the duct; and each conductive wire is embedded in an insulating strip.

5. The LED lamp according to claim 2, wherein the lateral portion of each conductive piece is fixed to the circuit board by a fastener.

* * * * *